US005448158A

United States Patent [19]

Ryat

[11] Patent Number: 5,448,158

[45] Date of Patent: Sep. 5, 1995

[54] PTAT CURRENT SOURCE

[75] Inventor: Marc H. Ryat, Fort Collins, Colo.

[73] Assignee: SGS-Thomson Microelectronics, Inc., Carrollton, Tex.

[21] Appl. No.: 175,648

[22] Filed: Dec. 30, 1993

[51] Int. Cl.[6] ..... G05F 3/16

[52] U.S. Cl. ..... 323/315; 327/512; 323/901; 323/312

[58] Field of Search ..... 307/370, 296.6, 296.7; 323/372, 375, 901, 907

[56] References Cited

U.S. PATENT DOCUMENTS

| | | | |
|---|---|---|---|
| 4,593,208 | 6/1986 | Single | 307/296 R |
| 4,678,876 | 10/1986 | Monticelli | 323/376 |
| 4,754,386 | 6/1988 | De Weerd | 363/27 |
| 4,769,589 | 9/1988 | Rosenthal | 323/373 |
| 5,173,656 | 12/1992 | Seevinck et al. | 323/374 |
| 5,258,702 | 11/1993 | Conzelmann et al. | 323/373 |
| 5,334,929 | 8/1994 | Schade, Jr. | 323/375 |

OTHER PUBLICATIONS

Grove, *Physics and Technology of Semiconductor Devices* (John Wiley & Sons, 1967) pp. 226, 227 and 212.

*Primary Examiner*—Thomas M. Dougherty

*Assistant Examiner*—Shawn Riley

*Attorney, Agent, or Firm*—Richard A. Bachand; Rodney M. Anderson; Lisa K. Jorgenson

[57] ABSTRACT

A current source for producing a current that is proportional to absolute temperature (i.e., "PTAT") is disclosed. The current source is based upon a circuit having a pair of current mirrors, one based upon MOS transistors and the other based upon bipolar transistors, where each of two legs in the current source include the series connection of one of the MOS transistors with one of the bipolar transistors. Further included in the disclosed circuit is a series connection of three MOS startup transistors, useful in starting up the current source in a non-critical manner. A startup current source, sourcing a non-critical startup current, turns on one of the MOS startup transistors that is connected in current mirror fashion with the MOS transistor current mirror, turning on both current mirrors. As the output current increases, the current through the MOS startup transistors also increases, until equilibrium is achieved. Early effects in the bipolar transistor current mirror are eliminated by maintaining the gate-to-source voltage of the MOS transistors equal, without requiring cascode transistors, and thus maintaining low voltage operating capability.

15 Claims, 1 Drawing Sheet

PTAT CURRENT SOURCE

BACKGROUND OF THE INVENTION

1. Field of the Invention

This invention relates to improvements in current source circuits, and more particularly to improvements in current source circuits that provide a current that is proportional to absolute temperature (PTAT). 2. Relevant Background Information Current source circuits that provide a current that is proportional to absolute temperature have many uses. In the past, such circuits suffered numerous deficiencies. Cascode current mirrors having a high output impedance, were necessary to force equal currents in two bipolar transistors of different emitter areas, thereby increasing the minimum operating supply. Also, reliable start-up was not enjoyed under all conditions. When start-up circuitry was present, it had to be disconnected from the circuit not to affect the output current value when an equilibrium was reached. Sensing of that equilibrium was also difficult to implement in a reliable way. Other shortcomings of the classical solutions were the use of operational amplifiers, or transistor current gain dependent output.

A typical PTAT current source 10, in accordance with the prior art, is shown in FIG. 1. The prior art circuit for generating a PTAT current has two complementary current mirrors, as shown in FIG. 1. The current source 10 includes a first current mirror that is provided by NPN bipolar transistors 11 and 12 and a current mirror provided by a P-channel MOS transistors 17 and 18. The two NPN transistors 11 and 12 connected as shown to provide respective current paths from a $V_{CC}$ rail 15 to ground 16 through respective MOS transistors 17 and 18. The bases of the NPN transistors 11 and 12 are interconnected to each other and to the collector of the NPN transistor 12. The emitters of the NPN transistors 11 and 12 are sized such that the emitter of the NPN transistor 11 is n-times larger than the emitter of the NPN transistor 12. A resistor 20, of value R, is connected between the emitter of the NPN transistor 11 and the ground rail 16. A current source 22 that provides a current of magnitude Istart is connected between the gates of the MOS transistors 17 and 18 and the ground rail 16. The gates of the MOS transistors 17 and 18 are interconnected with each other and to the drain of the MOS transistor 17. An output MOS mirror transistor 23 is connected to provide a current path from the $V_{CC}$ rail to an output terminal 24 from which the output current Iout is derived. The gate of the MOS transistor 23 is connected to the gates of the MOS transistors 17 and 18, whereby the output current Iout that is delivered to terminal 24 mirrors the current that flows through the MOS transistor 18 and NPN bipolar transistor 12.

If the mirrors are ideal, the collector currents of NPN transistors 11 and 12, $I_{c11}$ and $I_{c12}$, are equal. Thus:

$$n \cdot Is0 \cdot e^{\frac{Vbe11}{V_t}} = Is0 \cdot e^{\frac{Vbe12}{V_t}}$$

or, taking the logs:

$$V_{be12} V_{be11} + V_t \log(n).$$

Therefore, the voltage drop across the resistor 20, of value R, which has the value $V_{be12} - V_{be11}$, equals:

$$\text{RIout} = V_t \log(n)$$

With ideal mirrors, one should then obtain for the output current:

$$I_{out} = \frac{V_t \cdot \log(n)}{R}$$

Practical implementations of the circuit described, however, suffer from the non-ideal state-of-the-art current mirrors that result mainly from the Early effect on their outputs. Reducing this effect requires cascoding the mirrors, which then will not operate under low supply voltages. With respect to the lower mirror that includes the bipolar transistors 11 and 12, base current effects also need to be eliminated. The sources of error contribute to make the collector currents in the transistors 11 and 12, $I_{c11}$ and $I_{c12}$, different, and then the ideal PTAT relationship for Iout becomes inexact.

Another problem is the condition where the circuit 10 reaches its second equilibrium state at the moment of startup, corresponding to zero value collector currents in the transistors 11 and 12, i.e., $I_{c11} = I_{c12} = 0$. Since this equilibrium is also stable, it is generally avoided by adding the startup current source, Istart, 22 into the input of one of the mirrors to initiate current growth in the transistors at power up. Since this current source also affects the current output value when the equilibrium is reached, it needs to be disconnected from the mirrors at that time by an adequate detection circuitry that senses when the output has become stable. Such a detection circuit needs to disconnect the current source 22 precisely after the critical threshold of $$\frac{V_t \cdot \log(n)}{R}$$

has been crossed, not to abort the current growth in the mirrors before that point. It therefore requires a current source similar to the PTAT current we are considering, and would also make this circuit prone to oscillation, since the current in the mirrors also tends to recess and to drop back below the threshold when the current from the current source 22 is disabled too quickly.

In general, PTAT current sources suffer from either poor accuracy or uncertain startup behavior. If startup circuitry is proposed, it often affects the value of the output current, especially for large startup current values. Other circuits require the use of operational amplifiers, which are more costly in silicon area.

SUMMARY OF THE INVENTION

In light of the above, it is, therefore, an object of the invention to provide an improved current source circuit.

It is still another object of the invention to provide a current source circuit of the type described that produces an output current that is proportional to absolute temperature.

It is still another object of the invention to provide an improved current source circuit of the type described in which the outputs are essentially independent of the beta of the transistors used, resulting in very linear high temperature capabilities.

It is yet another object of the invention to provide a current source circuit of the type described that can be implemented without operational amplifiers, thus saving total circuit area.

It is yet another object of the invention to provide an improved current source circuit of the type described that is self-starting, and in which the output current is independent of the start-up current value, and from which the start-up current source does not have to be disconnected after current build-up, while still providing a beta-independent, multiple output.

These and other objects, features and advantages of the invention will be apparent to those skilled in the art from the following detailed description of the invention, when read in conjunction with the accompanying drawings and appended claims.

In accordance with a broad aspect of the invention, a PTAT current source is presented that has a first current mirror formed of bipolar transistors and a second current mirror formed of MOS transistors connected to the first current mirror. A resistor is connected between the bipolar transistors to produce a PTAT current in the first current mirror. A pair of bipolar mirror output transistors are connected between the first and second current mirrors, and a startup current source is connected to provide regenerative current growth in the mirrors. An output current MOS transistor is connected to mirror a current in one of the bipolar mirror output transistors. The bipolar transistors of the first current mirror can be NPN transistors, and the MOS transistors of the second current mirror can be PMOS devices. If desired, at least an additional output mirror circuit can be provided to produce at least an additional output PTAT current source. Also, a base current compensation circuit may be connected to the first current mirror to provide a bias that makes the PTAT current fully independent of a startup current from the startup current source.

In accordance with another broad aspect of the invention, a PTAT current source is presented. The PTAT current source has a first current mirror having first and second current flow paths, and including first and second bipolar transistors. A resistor is connected between the bases of the first and second bipolar transistors. A second current mirror has current flow paths connected in series with the respective first and second current flow paths of the first current mirror, the second current mirror having first and second MOS transistors. Third and fourth bipolar transistors are connected respectively in the first and second current flow paths, and a startup current source is connected between a reference potential and the gates of the first and second MOS transistors. Third, fourth and fifth MOS transistors are connected between a supply voltage and the reference potential, the third MOS transistor having a gate connected to the gates of the first and second MOS transistors, the fourth MOS transistor having a gate connected to the base of the first bipolar transistor, and the fifth transistor having a gate connected between the second and fourth bipolar transistors, the fifth MOS transistor being connected between the base of the first transistor and the reference potential. An MOS transistor is connected to mirror a current in the second current flow path.

In a preferred embodiment, the bipolar transistors are NPN transistors, with the first transistor having an emitter that is about n times as large as the emitter of the second transistor. The first, second, and third MOS transistors are PMOS devices, and the fourth and fifth MOS transistors and the output current MOS transistor are NMOS devices.

If desired, at least an additional output mirror circuit comprising an output MOS transistor may be connected between an output terminal and the reference potential, the at least an additional output mirror circuit connected to mirror a current is the fifth MOS transistor. The fifth MOS transistor is about twice as large as the output current MOS transistor.

In another preferred embodiment, a base current compensation circuit is provided. The base current compensating circuit has a sixth MOS transistor and a fifth bipolar transistor connected in series between the supply voltage and the reference potential. A seventh MOS transistor is connected between the supply voltage and the base of the second bipolar transistor. An eighth MOS transistor is connected between the supply voltage and a base of the fifth bipolar transistor, the sixth MOS transistor having a gate connected to the gate of the third MOS transistor, and the seventh and eighth MOS transistors each having a gate connected to the fifth bipolar transistor, wherein the output current is fully independent of the startup current.

BRIEF DESCRIPTION OF THE DRAWING

The invention is illustrated in the accompanying drawings, in which.

DETAILED DESCRIPTION OF THE PREFERRED EMBODIMENTS

Figure 2:
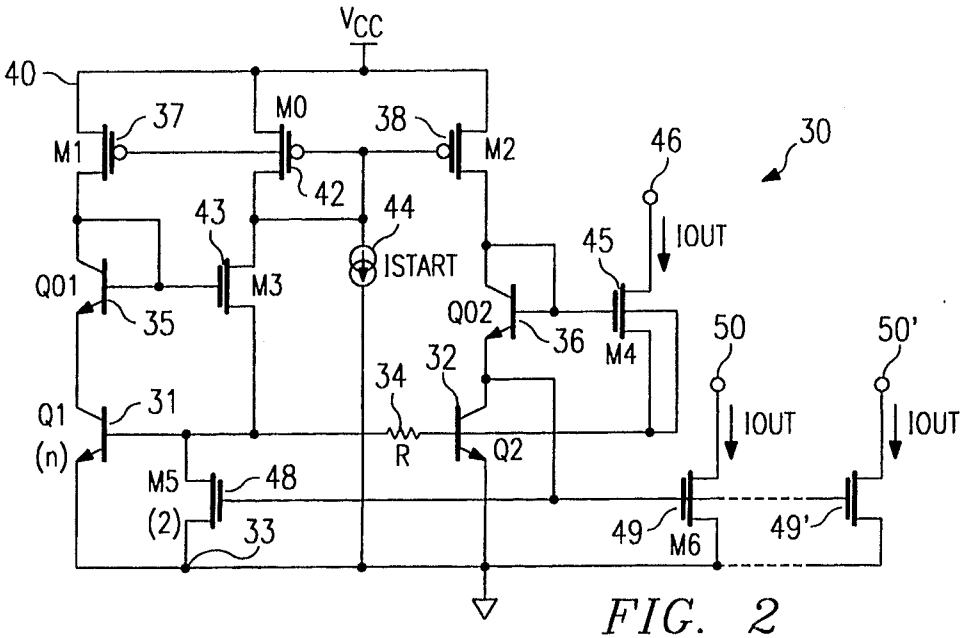
FIG. 2 is an electrical schematic diagram of a PTAT current source, in accordance with a preferred embodiment of the invention.
Figure 1:
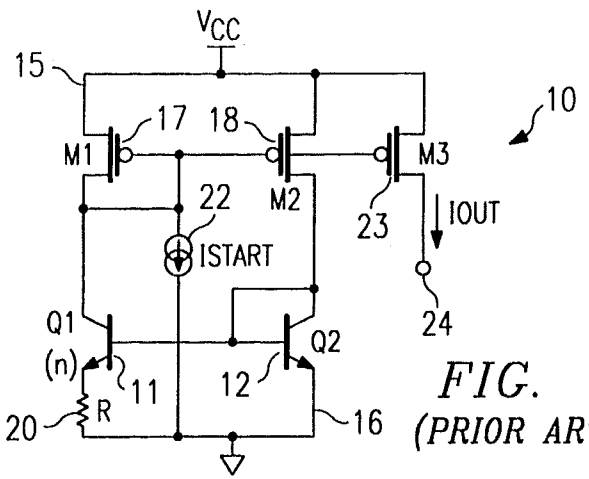
FIG. 1 (PRIOR ART)
FIG. 1 is an electrical schematic diagram of a PTAT current source, in accordance with the prior art.

A PTAT current source 30, in accordance with the invention, is shown in FIG. 2. The PTAT current source 30 has two bipolar NPN transistors 31 and 32 having emitters connected to a ground rail 33. A resistor 34, of value R, is connected between the bases of the transistors 31 and 32. The emitter of the NPN transistor 31 is sized to be n times larger than the emitter of the NPN transistor 32.

A second set of NPN bipolar transistors 35 and 36 are provided in the respective current flow paths of NPN transistors 31 and 32. The base and collector of each of the NPN transistors 35 and 36 are interconnected. A pair of P-channel MOS (PMOS) transistors 37 and 38 are additionally provided in the respective current flow paths of the NPN transistors 31 and 32, connected at their respective drain terminals to the $V_{CC}$ rail 40.

A PMOS transistor 42 is connected between the $V_{CC}$ rail 40 and an N-channel MOS (NMOS) transistor 43 to provide a current flow path between the $V_{CC}$ rail 40 and the base of the NPN transistor 31. The gate of the PMOS transistor 42 is connected to the respective gates of PMOS transistors 37 and 38, as well as to its own drain. Additionally, a current source 44 is connected between the gate connections of the PMOS transistors 37, 38, and 42 and the ground rail 33. The NMOS transistor 43, on the other hand, has its gate connected to the base of the NPN transistor 35.

Finally, an additional NMOS mirror transistor 45 is connected between a current output terminal 46 and the base of the NPN transistor 32. The gate of the NMOS transistor 45 is connected to the base of the NPN transistor 36. Thus, a current output, Iout, is provided at the current output terminal 46 to the circuit.

An additional mirror circuit includes an NMOS transistor 48 connected between the base of the NPN transistor 31 and the ground rail 33. The NMOS transistor 48 is twice the size of the NMOS output mirror transistor 45. Any number of additional NMOS transistors 49, 49', . . . may be provided between respective output terminals 50, 50', . . . and the ground rail 33, as shown The gates of the NMOS transistors 48, 49, 49', . . . are interconnected to each other and to the emitter of the NPN transistor 36. Thus, each of the output mirror NMOS transistors 49, 49', . . . provides an output current, Iout, from its respective output terminals 50 50', . . .

In the operation of the circuit 30, the current source 44 provides a non-critical amount of startup current into the PMOS mirror input at the gate of the PMOS transistor 42. This current is duplicated by the PMOS transistors 37 and 38 into the NPN transistors 31 and 32, forcing current into their collectors. At the same time, the NMOS transistor 48 provides current to the sources of the NMOS transistor 43 by mirroring the current in the isolated NMOS transistor 45.

$$V_{GS48}=V_{be32}+V_{GS45}-V_{be36}=V_{GS45},$$

since the NMOS transistor 45 has an isolated bulk (i.e., no body effect), and the same current is flowing through the NPN transistors 32 and 36. Since NMOS transistor 48 is twice the size of the NMOS transistor 45, the output current is half the value of the current that flows through the NMOS transistor 48, and is equal to the current that flows through the NMOS transistor 45.

The current through the NMOS transistor 43 is $I_{48}-$Iout=Iout, because Iout is the current flowing through the resistor 34, which feeds into the PMOS transistor 42, therefore providing regenerative current growth in the PMOS mirror. Even for a small value of Istart that may be provided by the current source 44, a small amount of current will be created in the NMOS transistor 48, which will be fed back into PMOS transistor 42. This makes the initial current, current through PMOS transistor 42 grow until equilibrium has been reached. At that point, $I_{c31}=I_{c32}$ (the collector currents of the NPN transistors 31 and 32). The difference between the Vbe's of the transistors 31 and 32 is converted by the resistor 34 into the desired PTAT current, and $$I_{out}=\frac{V_t\cdot\log(n)}{R}.$$

Early effects in the PMOS mirror have been eliminated since the PMOS transistors 37 and 38 have equal drain to source voltages, namely, $V_{DD}-V_{be31}-V_{GS43}$, if the NMOS transistors 43 and 45 have equal sizes, and if the NMOS transistor 43 is also isolated. The NMOS transistor 43 is sized such that its $V_{GS}$ is the same as the $V_{GS}$ of NMOS transistor 45, if it is not isolated. The Early effects between transistors 31 and 32 have also been eliminated for the same reason, without cascoding.

It is noted that the circuit provides a high impedance output from the drain of the NMOS transistor 45 and enables a connection for multiple outputs at the gate of the NMOS transistor 48. The value of Istart provided by the current source 44 only affects the output current through the base current of the NPN transistor 32, and is therefore divided by the current gain of the NPN transistors 31 and 32.

Figure 3:
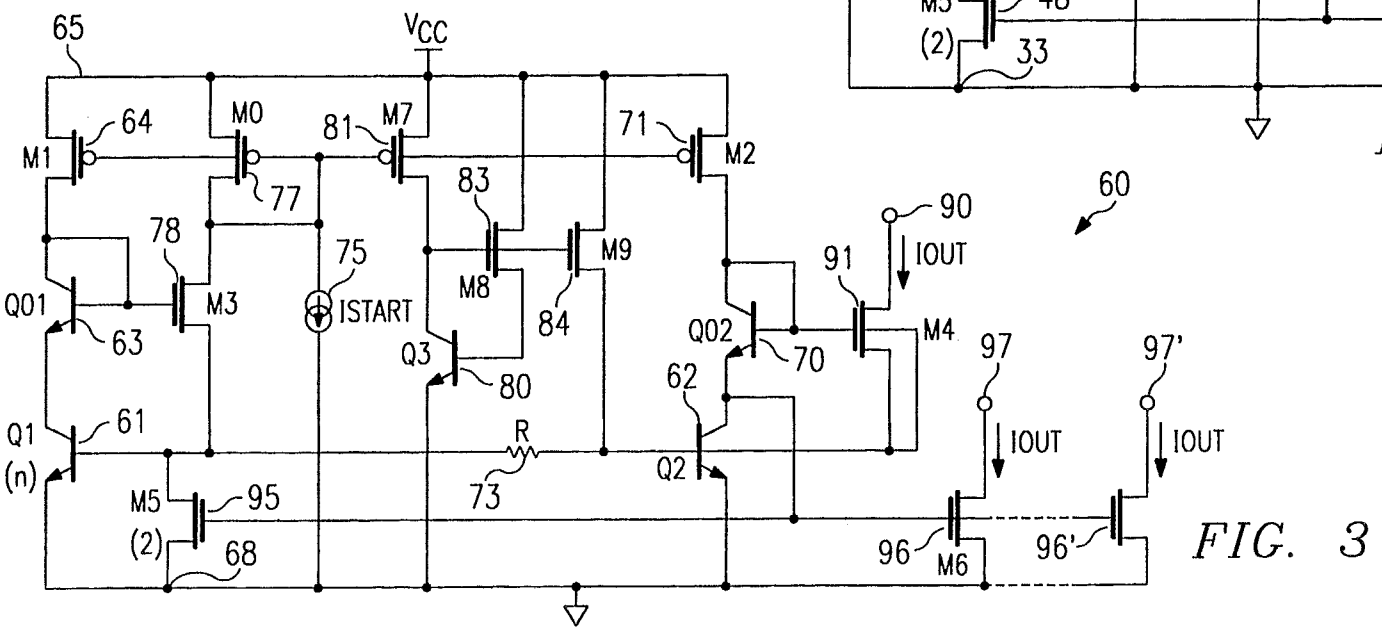
FIG. 3 is an electrical schematic diagram of a PTAT current source, in accordance with another preferred embodiment of the invention.

Another embodiment of the PTAT current source of the invention, denoted by the reference numeral 60, is shown in FIG. 3. The PTAT current source 60 includes two NPN transistors 61 and 62. The base of the NPN transistor 63 is connected to its collector. The base of the NPN transistor 63 is also connected to the gate of the NMOS transistor 78. The NPN transistor 61 is connected in a current path that includes a second NPN transistor 63 and an MOS transistor 64, between the $V_{CC}$ rail 65 and a ground rail 68. Likewise, the NPN transistor 62 is connected in a current path that includes a second NPN transistor 70 and a PMOS transistor 71 connected between the $V_{CC}$ rail 65 and the ground rail 68. The bases of the NPN transistors 61 and 62 are connected by a resistor 73, having a value R. Likewise, the gates of the PMOS transistors 64 and 71 are interconnected. The base of the NPN transistor 70 is connected to its collector and to the gate of the NMOS mirror transistor 91.

The current source 75 is connected between the gates of the PMOS transistors 64 and 71 and the ground rail 68 to provide a start current to the circuit 60. A PMOS transistor 77 and an NMOS transistor 78 are connected between the $V_{CC}$ rail 65 and the base of the NPN transistor 61. The gate of the PMOS transistor 77 is connected to the gates of the PMOS transistors 64 and 71, and the gate of the NMOS transistor 78 is connected to the base of the NPN transistor 63. The gate of the PMOS transistor 77 is also connected to its drain.

In the circuit embodiment 60 shown in FIG. 3, an additional circuit is provided that includes an additional NPN transistor 80 and an additional PMOS transistor 81 connected between the $V_{CC}$ rail 65 and the ground rail 68. An NMOS transistor 83 is connected between the $V_{CC}$ rail 65 and the base of the NPN transistor 80, and an additional NMOS transistor 84 is connected between the $V_{CC}$ rail 65 and the base of the active NPN transistor 62. The gates of the NMOS transistors 83 and 84 are connected to each other and to the collector of the NPN transistor 80. Additionally, the gate of the PMOS transistor 81 is connected to the gate of the PMOS transistor 77. Thus, the current that flows in the flow path that includes the PMOS transistor 81 and NPN transistor 80 mirrors the current that flows in the current path that includes transistors 71 and 62.

The output current, Iout, from the circuit 60 is provided at a current output terminal 90 that is connected to an NMOS mirror transistor 91 to provide a current flow path from the terminal 90 to the base of the active NPN transistor 62.

In a manner similar to that described above with respect to the circuit embodiment 30 of FIG. 2, additional current outputs can be provided from the circuit embodiment 60 shown in FIG. 3. To ensure regenerative startup, an output NMOS transistor 95 is provided that is twice the size of the NMOS mirror transistor 91. To provide additional current outputs, output NMOS mirror transistors 96, 96', . . . are provided, wherein the output currents Iout are provided at output terminals 97, 97', . . . in a current flow path between the respective terminals 97, 97', . . . and the ground rail 68.

The NMOS transistor 95 is connected to provide a current flow path between the base of the NPN transistor 61 and the ground rail 68. Additionally, the gates of the three NMOS transistors 95, 96, 96', . . . are connected to each other and to the emitter of the NPN transistor 70.

The operation of the circuit 60 shown in FIG. 3 is essentially the same as that described above with reference to the circuit 30 shown in FIG. 2, however, with base current compensation at the base of the NPN transistor 62 that makes the output current Iout fully independent of the value Istart of the current provided by the current source 75. Thus, the PTAT current provided is nearly ideal at the drain of the NMOS transistor 91, and there is essentially no base current error.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

I claim:

1. A current source for providing a current proportional to absolute temperature, comprising:

a first current mirror having first and second current flow paths, and including first and second bipolar transistors;

a resistor connected between the bases of said first and second bipolar transistors;

a second current mirror having current flow paths connected in series with the respective first and second current flow paths of said first current mirror, and including first and second MOS transistors;

third and fourth bipolar transistors connected respectively in said first and second current flow paths;

a startup current source connected between a reference potential and the gates of said first and second MOS transistors;

third, fourth and fifth MOS transistors having their source/drain paths connected in series between a supply voltage and the reference potential, said third MOS transistor having its gate connected to the gates of said first and second MOS transistors, the fourth MOS transistor having its gate connected to the base of said first bipolar transistor, and the fifth MOS transistor having its gate connected to a node in the second current flow path between the second and fourth bipolar transistors and having its source/drain path connected between the base of said first bipolar transistor and the reference potential;

and an output current MOS transistor connected to mirror a current in said second current flow path.

2. The current source of claim 1 wherein said bipolar transistors are NPN transistors

3. The current source of claim 2 wherein said bipolar transistor has emitter that is substantially larger than the emitter of said second bipolar transistor.

4. The current source of claim 2 wherein said first, second, and third MOS transistors are PMOS devices.

5. The current source of claim 2 wherein said fourth and fifth MOS transistors are NMOS devices.

6. The current source of claim 5 wherein said output current MOS transistor is an NMOS device.

7. The current source of claim 1, further comprising an additional output MOS transistor having its source/drain path connected between an output terminal and the reference potential, said additional output MOS transistor connected to mirror a current in said fifth MOS transistor.

8. The current source of claim 1 wherein the current conducted by said fifth MOS transistor is about twice as large as the current conducted by said output current MOS transistor.

9. The current source of claim 1, further comprising:

a base current compensation circuit comprising:

a sixth MOS transistor and a fifth bipolar transistor connected in series between the supply voltage and the reference potential;

a seventh MOS transistor connected between the supply voltage and the base of the second bipolar transistor; and an eighth MOS transistor connected between the supply voltage and a base of the fifth bipolar transistor, said sixth MOS transistor having a gate connected to the gate of said third MOS transistor, and said seventh and eighth MOS transistors each having a gate connected to the fifth bipolar transistor.

10. The current source of claim 9 wherein said bipolar transistors are NPN transistors.

11. The current source of claim 10 wherein said first bipolar transistor has an emitter that is about twice as large as an emitter of said second bipolar transistor and said first MOS transistor is about twice as large as said second MOS transistor.

12. The current source of claim 9 wherein said first, second, third, and sixth MOS transistors are PMOS devices.

13. The current source of claim 9 wherein said fourth, fifth, seventh, and eighth MOS transistors are NMOS devices.

14. The current source of claim 9, further comprising an additional output MOS transistor having its source/drain path connected between an output terminal and the reference potential, said additional output MOS transistor connected to mirror a current in said fifth MOS transistor.

15. The current source of claim 9 wherein the current conducted by said fifth MOS transistor is about twice as large as the current conducted by said output current MOS transistor.

* * * * *

UNITED STATES PATENT AND TRADEMARK OFFICE

CERTIFICATE OF CORRECTION

PATENT NO : 5,448,158

DATED : September 5, 1995

INVENTOR(S) : Marc H. Ryat

It is certified that error appears in the above-identified patent and that said Letters Patent are hereby corrected as shown below:

Column 7, line 46, change "first" to --third--.

Signed and Sealed this

Seventh Day of October, 1997

*Attest:*

Bruce Lehman

BRUCE LEHMAN

*Attesting Officer*

*Commissioner of Patents and Trademarks*